United States Patent [19]

Heller et al.

[11] 4,150,940

[45] Apr. 24, 1979

[54] CIGARETTE LIGHTER

[75] Inventors: Heinz Heller, Rodenkirchen; Winfried Brand, Troisdorf; Peter Gogovic, Leverkusen, all of Fed. Rep. of Germany

[73] Assignee: Ronson Gesellschaft mit beschränkter Haftung, Cologne, Fed. Rep. of Germany

[21] Appl. No.: 827,379

[22] Filed: Aug. 24, 1977

[30] Foreign Application Priority Data

Aug. 27, 1976 [DE] Fed. Rep. of Germany ..... 2639242

[51] Int. Cl.[2] ..... F23Q 2/08

[52] U.S. Cl. ..... 431/130; 431/255

[58] Field of Search ..... 431/129, 130, 131, 132, 431/255, 344

[56] References Cited

U.S. PATENT DOCUMENTS

| | | | |
|---|---|---|---|
| 2,616,947 | 11/1952 | Howard-Jones | 431/132 |
| 4,022,566 | 5/1977 | Goto | 431/132 |
| 4,060,373 | 11/1977 | Paroty | 431/129 X |

*Primary Examiner*—Edward G. Favors

*Attorney, Agent, or Firm*—Toren, McGeady and Stanger

[57] ABSTRACT

In a cigarette lighter including a housing containing an ignition mechanism, a cap-type member is pivotally mounted on the open end of the housing. The cap-type member includes a lug extending outwardly through an opening in the housing. The lug bears against an edge of the opening and the edge provides a fulcrum about which the lug and, in turn, the cap-type member pivot into the housing. The cap-type member is in engagement with the ignition mechanism so that it actuates the ignition mechanism when it is pivoted into the housing.

6 Claims, 1 Drawing Figure

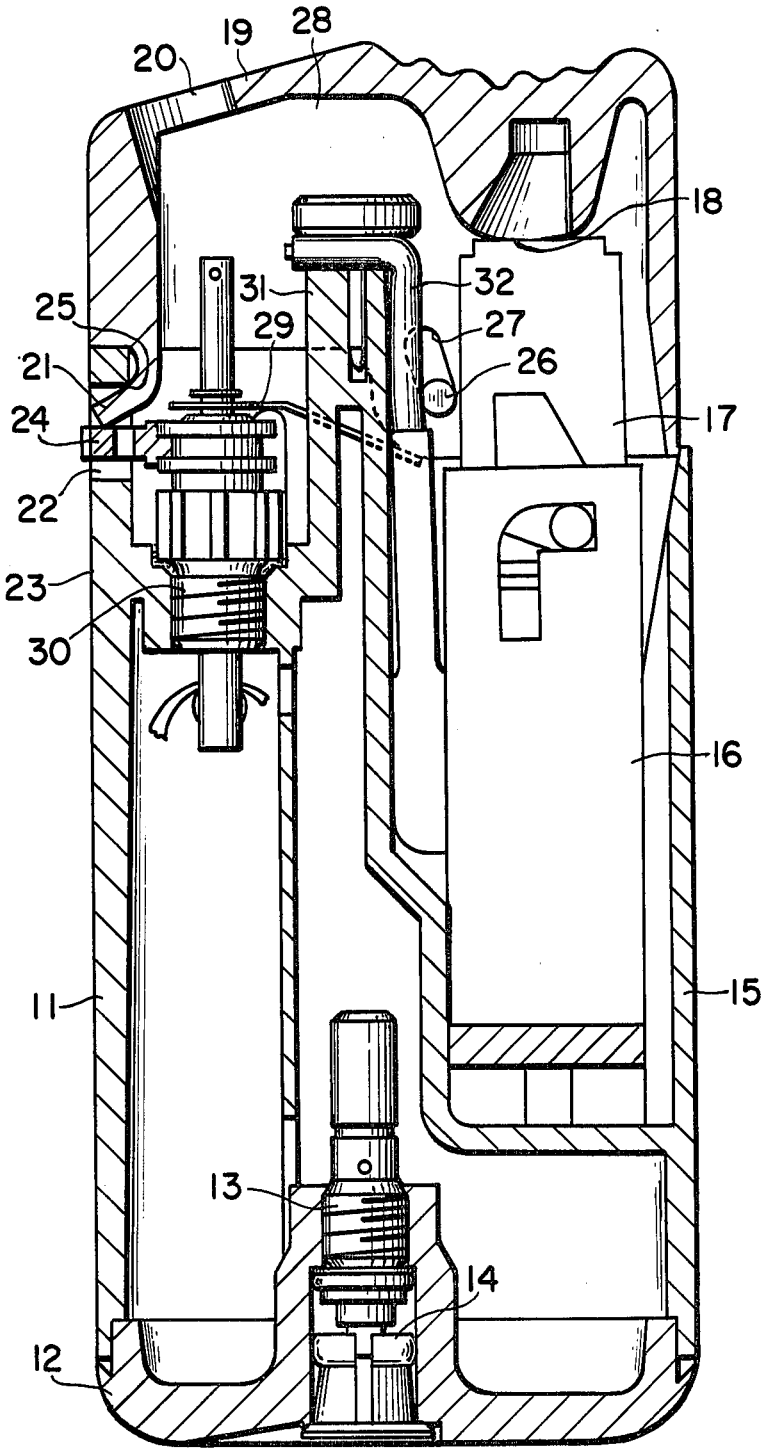
19
28
20
18
31
32
25
29
27
21
26
24
17
22
23
30
16
11
15
13
14
12

CIGARETTE LIGHTER

SUMMARY OF THE INVENTION

This invention relates to a cigarette lighter of the kind having a housing on one end of which is mounted a cap type member for actuating the ignition mechanism.

Lighters of this kind are known in which the cap type actuating member is pivotally mounted on a pin which extends between the side walls of the housing. Such arrangements are not particularly satisfactory, especially in the case of lighters having comparatively narrow side walls, since the distance between the pivotal axis of the actuating member and the point at which an actuating force may be applied by the user is rather small, particularly if as is usually the case for constructional reasons the pivot pin is located more or less midway between the front and back walls of the housing. This results in an undesirable increase in the effort needed to operate the lighter. In addition the provision of a satisfactory bearing pin is comparatively expensive and the bearings are subject to wear and tear.

It is an object of the present invention to provide a construction which simplifies the mounting of a cap type actuating member and also maximises the said distance whereby to reduce the effort required to operate the ignition mechanism.

According to the present invention the front wall of the lighter housing is formed with an opening and the front end of the actuating member is formed with a lug which extends into the opening and engages the outer edge thereof, this edge forming a fulcrum about which the actuating member pivots.

In such construction and with the point on the actuating member at which the user applies an actuating force arranged as near as possible to the back end of the member the distance between the said point and the pivotal axis of the member is maximised with a corresponding reduction in the effort required to operate the lighter.

In one convenient constructional arrangement the said opening may be that opening which is provided in a gas fuelled lighter for the setting arm of the flame height adjusting means of the burner valve.

The movement of the actuating member may be limited by a pin which extends between the side walls of the housing and passes through a slot or slots formed in the member.

Preferably the actuating member is biased by spring means to a rest position in which the pin engages one end of the slot or slots and such means may be constituted by a spring biased operative plunger of a piezo-electric ignition mechanism.

The actuating member is conveniently formed with a flame outlet opening in the vicinity of its front end and with a cam surface for operating a piezo-electric ignition mechanism in the vicinity of its back end.

One form of a lighter in accordance with this invention will now be described with reference to the accompanying drawing which is a central longitudinal section of a gas fuelled lighter having piezo-electric ignition means.

The illustrated lighter comprises a housing 11 in the base 12 of which a filling valve 13 is arranged, access to this valve being normally closed off by a cap 14. The housing is formed adjacent its rear wall 15 with a chamber which accommodates a piezo-electric mechanism 16. This mechanism includes a plunger 17 which is operated on by a cam shaped surface 18 formed on the interior of a cap-type actuating member 19 and in the vicinity of its back end. The member is also provided with a flame outlet opening 20 in the vicinity of its front end.

The actuating member 19 is formed at its front end with a guide lug 21 which engages in an opening 22 formed in the front wall 23 of the housing 11. The setting arm 24 of a flame height adjuster also projects through this opening 22.

The guide lug 21 engages the outer edge 25 of the opening 22 and this edge constitutes a fulcrum about which the actuating member 19 pivots. The movement of the actuating member is limited by a pin 26 which extends between the side walls of the housing 11 and passes through slots 27 formed in the side walls 28 of the actuating member.

In the rest position of the actuating member 19 the lower ends of the slots 27 are engaged by the pin 26, the actuating member being biased to this position by spring means which in the lighter illustrated are constituted by the plunger 17 which is biased by spring means towards the cam shaped surface 18 of the actuating member 19. A lever 29, which is engaged at one end by the actuating member 19, operates to open a burner valve 30 when the member is actuated. Preferably this lever is of stirrup shape and arranged with the arms passing on either side of a column shaped holder 31 for an electrode 32.

What we claim is:

1. A cigarette lighter of the kind having a housing on one end of which is mounted a cap-type member for actuating the ignition mechanism wherein the front wall of the housing is formed with an opening and the front end of the actuating member is formed with a lug which extends into the opening and engages the outer edge thereof, this edge forming a fulcrum about which the actuating member pivots and said opening is an opening provided for the setting arm of the flame height adjusting mechanism of a burner valve.

2. A ligher as claimed in claim 1 wherein movement of the actuating member is limited by a pin which extends between the side walls of the housing and passes through a slot or slots in the actuating member.

3. A lighter as claimed in claim 2 wherein the actuating member is biased by spring means to a rest position in which the pin engages one end of the slot or slots.

4. A lighter as claimed in claim 3 wherein the spring means is constituted by the spring biased operating plunger of a piezo-electric ignition mechanism.

5. A lighter as claimed in claim 1 wherein the actuating member is formed, in the vicinity of its front end, with a flame outlet opening and, in the vicinity of its back end, with a cam surface for operating a piezo-electric ignition mechanism.

6. A cigarette lighter of the kind having a housing with an open end, an ignition mechanism located within said housing, a cap-type member pivotally mounted on said housing having a front wall with an opening therein into the interior of said housing, said cap-type member having a lug thereon located within said housing and extending outwardly through the opening in the front wall thereof, and said lug disposed in contacting engagement with an edge of the opening so that the edge forms a fulcrum about which the cap-type member pivots.

* * * * *